US011261649B2

(12) United States Patent
Helligrath et al.

(10) Patent No.: US 11,261,649 B2
(45) Date of Patent: Mar. 1, 2022

(54) VEHICLE WINDOW CONTROL SYSTEM AND METHOD THEREOF

(71) Applicant: Honda Motor Co., Ltd., Tokyo (JP)

(72) Inventors: Eric E. Helligrath, Cincinnati, OH (US); David G. Peterson, East Liberty, OH (US); Kentaro Yoshimura, Dublin, OH (US)

(73) Assignee: Honda Motor Co., Ltd., Tokyo (JP)

( * ) Notice: Subject to any disclaimer, the term of this patent is extended or adjusted under 35 U.S.C. 154(b) by 155 days.

(21) Appl. No.: 16/049,437

(22) Filed: Jul. 30, 2018

(65) Prior Publication Data

US 2020/0032570 A1 Jan. 30, 2020

(51) Int. Cl.
*E05F 15/70* (2015.01)

(52) U.S. Cl.
CPC ..... *E05F 15/70* (2015.01); *E05Y 2900/55* (2013.01)

(58) Field of Classification Search
CPC ... E05F 15/70; E05Y 2900/55; E05Y 2400/42
See application file for complete search history.

(56) References Cited

U.S. PATENT DOCUMENTS 5,543,692 A * 8/1996 Howie ..... H02H 7/0851 318/280
5,773,942 A * 6/1998 Takahara ..... B60R 16/0315 318/280
6,032,415 A 3/2000 Tajima
6,100,658 A 8/2000 Kume et al.
6,274,947 B1 8/2001 Terashima
6,366,042 B1 4/2002 Gerbetz
6,515,377 B1 * 2/2003 Ubelein ..... B60J 7/0573 307/10.1
7,021,001 B1 4/2006 Schooler
7,023,161 B2 4/2006 Iwasaki et al.
7,145,299 B2 * 12/2006 Noro ..... E05F 15/695 318/49
7,305,290 B2 12/2007 Russ et al.
7,605,554 B2 10/2009 Kunkel
8,080,961 B2 12/2011 Miller
8,604,743 B2 12/2013 Zellmer et al.
8,827,027 B2 9/2014 Syvret et al.
9,033,394 B2 5/2015 Heirtzler et al.
9,461,462 B2 10/2016 Nagahama
9,617,777 B2 4/2017 Aoshima et al.
9,879,464 B2 1/2018 Hernandez-Urbina et al.
2004/0154904 A1 * 8/2004 Varga ..... H01H 25/04 200/5 A
2008/0100241 A1 * 5/2008 Takahashi ..... H02H 7/0851 318/283

(Continued)

*Primary Examiner* — Thomas Ingram
*Assistant Examiner* — Omar K Morsy
(74) *Attorney, Agent, or Firm* — American Honda Motor Co., Inc.; Suzanne B. Gagnon

(57) ABSTRACT

A vehicle window control system is provided. The vehicle window control system includes a window switch that generates a first signal, a first computer that reads a state of the window switch and generates a second signal, and a second computer that controls movement of the vehicle window based on either the first signal or the second signal. The second computer receives the second signal from the first computer through serial communication and the first signal from the switch portion through a hardwire.

13 Claims, 9 Drawing Sheets

(56) References Cited

U.S. PATENT DOCUMENTS

| | | | | |
|---|---|---|---|---|
| 2010/0332086 | A1 | 12/2010 | Zhao | |
| 2011/0160935 | A1* | 6/2011 | Newman | B60H 1/00735 701/2 |
| 2014/0052346 | A1 | 2/2014 | Heirtzler et al. | |
| 2016/0222712 | A1* | 8/2016 | Nishio | B60J 1/08 |
| 2017/0254136 | A1 | 9/2017 | Li et al. | |
| 2018/0152579 | A1* | 5/2018 | Iwasa | H04N 1/32641 |

* cited by examiner

VEHICLE WINDOW CONTROL SYSTEM AND METHOD THEREOF

TECHNICAL FIELD

The present disclosure relates to a vehicle window control system. More particularly, the present disclosure relates to a vehicle window control system that operates to open and close a vehicle window through a serial communication.

BACKGROUND

A power window system in a vehicle is installed to electrically open and close a window in response to operation of a switch provided in a switch module. In such a power window system, a vehicle user operates the switch so that the motor drives a slide member of a regulator up or down to open or close the window. Such a power window system includes a control unit that operates to open/close the window in response to operation of the switch. The control unit is generally integrated with the switch on the switch module.

It is known to provide a power window system that separately includes a switch module and a control unit. The switch module and the control unit communicate with each other through a serial communications such as through a local Interconnect Network (LIN) or through a Controller Area Network (CAN). Such arrangement allows the switch module to be reduced in size.

The serial communication between the switch module and the control unit is quite high in reliability specifically with the signal transmission/reception and information exchange, however the likelihood of errors or failures is not zero. If such errors or failures occur when the window is fully or partially open, a user cannot close the window. As a result, the open window may allow rain or other objects to enter into a vehicle cabin or the open window may cause an unwanted entry.

Accordingly, it would be advantageous to provide a power window system that allows a user to close a window when serial communication between a switch and a control unit fails.

SUMMARY

In accordance with one embodiment, a vehicle window control system may include a window switch that generates a first signal, a first computer that reads a state of the window switch and generates a second signal, and a second computer that controls movement of the vehicle window based on either the first signal or the second signal. The second computer may receive the second signal from the first computer through serial communication and the first signal from the window switch through a hardwire.

In accordance with another embodiment, a vehicle window control method may include steps of obtaining a first signal through a hardwire that is connected with a window switch, obtaining a second signal through a serial communication that is connected with the window switch through a first computer that reads a state of the window switch, and closing the vehicle window based on either the first signal or the second signal.

In accordance with yet another embodiment, a vehicle window control system comprising: a window switch that generates a first signal, a first computer that reads a state of the window switch and generates a second signal, and a second computer that controls movement of the vehicle window based on either the first signal or the second signal. The second computer may prioritize the first signal over the second signal when the second computer determines that the first computer fails.

The figures depict various views of the embodiments for purposes of illustration only. One skilled in the art will readily recognize from the following discussion that alternative embodiments of the structures and methods illustrated herein may be employed without departing from the principles of the embodiments described herein.

DETAILED DESCRIPTION

In the following description, various embodiments will be described. For purposes of explanation, specific configurations and details are set forth in order to provide a thorough understanding of the embodiments. However, it will also be apparent to one skilled in the art that the embodiments may be practiced without the specific details. Furthermore, well-known features may be omitted or simplified in order not to obscure the embodiment being described.

Figure 1:
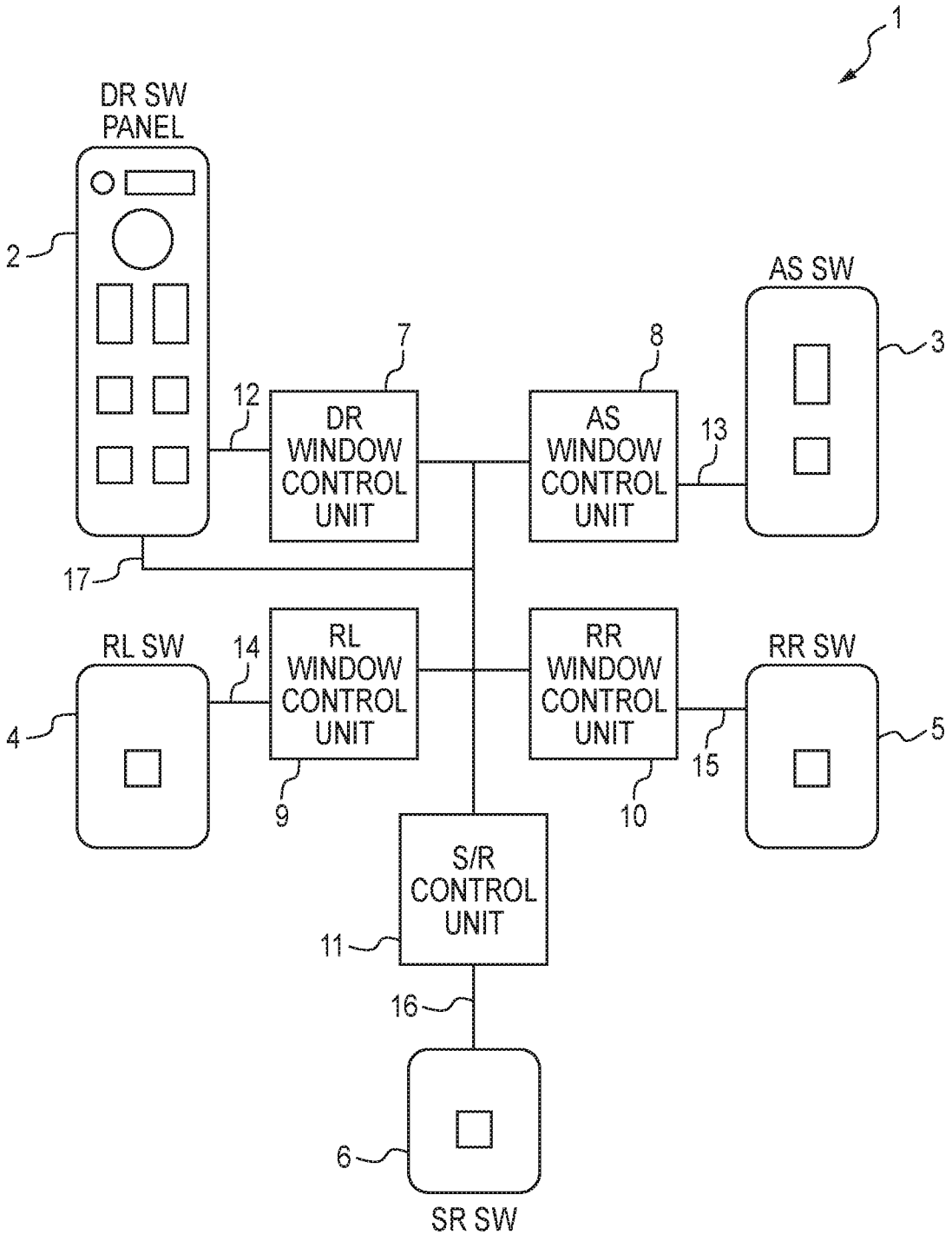
FIG. 1 is an overall diagram of a vehicle window control system.

FIG. 1 shows a block diagram of an overall vehicle window control system 1. The vehicle window control system 1 includes a driver window switch panel 2, an assistant window switch panel 3, a rear left window switch panel 4, a rear right window switch panel 5 and a sunroof switch panel 6. The driver window switch panel 2 includes a switch to open/close a driver side window and switches to open/close non-driver side windows. The driver window switch panel 2 may also include other switches such as a switch to control door mirrors or a switch to lock/unlock all the vehicle doors. The assistant window switch panel 3 includes a switch to open/close an assistant side window. The assistant window switch panel 3 may include other switches such as a switch to lock/unlock all the vehicle doors. Each of the rear left window switch panel 4, the rear right window switch panel 5 and the sunroof switch panel 6 includes a switch to open/close corresponding vehicle windows. The switches on the switch panels 2-6 are manipulated by users of the vehicle. The vehicle control system 1 also includes a driver window control unit 7, an assistant window control unit 8, a rear left window control unit 9, a rear right window control unit 10 and a sunroof control unit 11. Those control units 7-11 are connected with corresponding switch panels 2-6 and control corresponding motors M (see FIG. 2) installed to open and close the vehicle windows. Also the driver window switch panel 2 is connected with the control units 7-11 through a serial communication such as through a Local Interconnect Network (LIN) or a Controller Area Network (CAN) so that a user can open/close not only the driver side window but also non-driver side windows by the driver window switch panel 2. Further, the driver window switch panel 2 is connected with the driver window control unit 7 through a hardwire 12. The other window switch panels 3-6 also connected with the corresponding window control units 8-11 through hardwires 13-16.

A communication through the hardwires 12-16 can send HIGH (ON) or LOW (OFF) signals. A communication through the serial communication can send more complicated signals than just HIGH (ON) or LOW (OFF) by using digital sequences.

Figure 2:
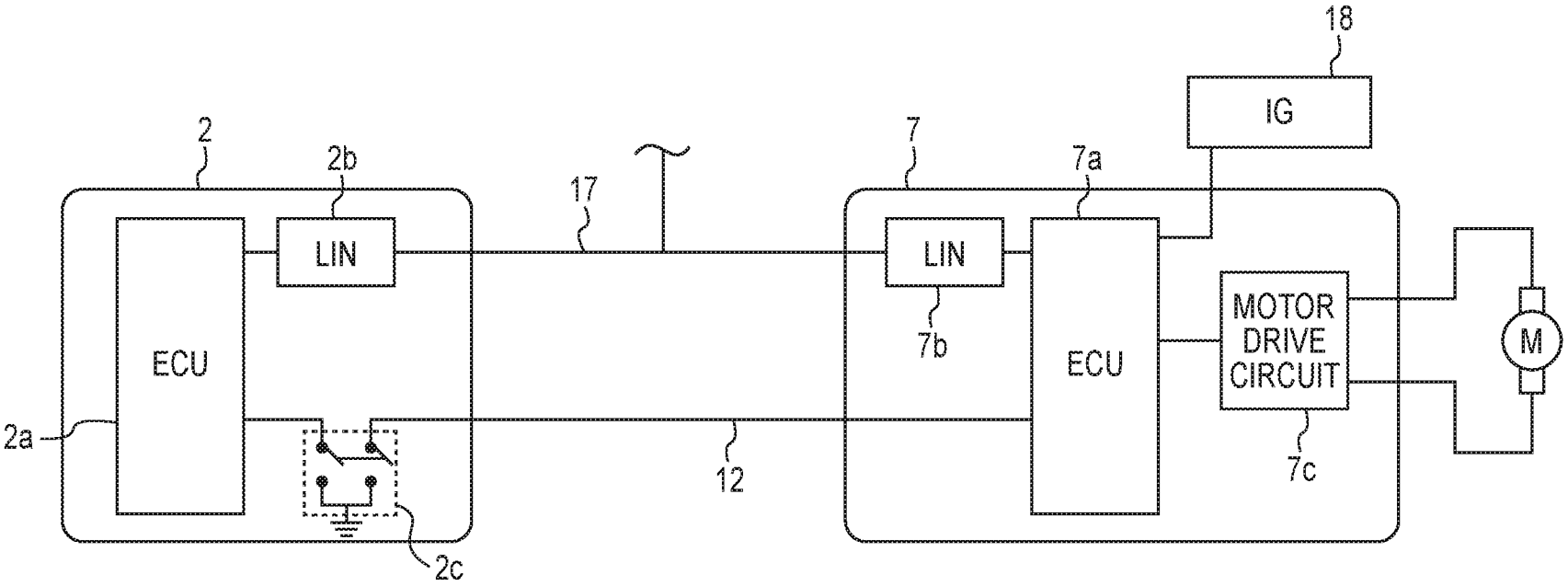
FIG. 2 is a detailed diagram of a vehicle window control system.

FIG. 2 shows a detail chart of the driver window switch panel 2 and the driver window control unit 7. The driver window switch panel 2 and the driver control unit 7 are separately installed in the vehicle. For example, the driver window switch panel 2 may be installed in an armrest of a door panel of the vehicle, while the driver control unit 7 may be installed inside of the door panel. The driver window switch panel 2 includes a switch detection portion 2*a*, a first serial communication interface 2*b*, a manual up switch 2*c* and a manual down switch (not shown). The driver window control portion 7 includes a control portion 7*a*, a second serial communication interface 7*b* and a motor drive circuit 7*c*. The switch detection portion 2*a* is connected with the control portion 7*a* through the first serial communication interface 2*b* and the second serial communication interface 7*b*. The communication between the first serial communication interface 2*b* and the second serial communication interface 7*b* is made by the serial communication. Also the switch detection portion 2*a* is connected with the control portion 7*a* through a serial communication line 17. The manual up switch 2*c* includes at least two switches. The two switches are connected with each other and thus the two switches move together when the user operates the manual up switch 2*c*. The one switch is connected with the switch detection portion 2*c* and the other switch is connected with the control portion 7*a*. The motor drive circuit 7*c* is connected with the control portion 7*a* and the motor M. The control portion 7*a* receives a signal indicating a state whether an ignition switch 18 of the vehicle is turned ON or OFF. The control portion 7*a* may receive a signal indicating a state whether a main switch of a vehicle is turned ON or OFF, if the vehicle is an electric vehicle without engine. The manual up switch 2*c* is a type of a switch which closes the vehicle window only while holding the switch in an UP position. The manual up switch 2*c* may include auto-up functionality that allows the user to fully open/close the vehicle window in response to certain switch operation. The manual down switch (not shown) is a type of a switch which opens the vehicle window only while holding the switch in a down portion or fully opens the vehicle window in response to certain switch operations.

Once the manual up switch 2*c* is operated by the user, the control portion 7*a* receives a first signal through the hardwire 12 and reads the amount the manual up switch 2*c* is operated based on the first signal. Also once the manual up switch 2*c* is operated by the user, the switch detection portion 2*a* reads the amount the manual up switch 2*c* is operated and transmits the amount to the control portion 7*a* through the first serial communication interface 2*b* and the second serial communication interface 7*b*, and the control portion 7*a* receives the amount as a second signal. Then the control portion 7*a* commands the motor drive circuit 7*c* the amount the motor M should rotate in order to open/close the vehicle window by the requested amount.

Figure 3:
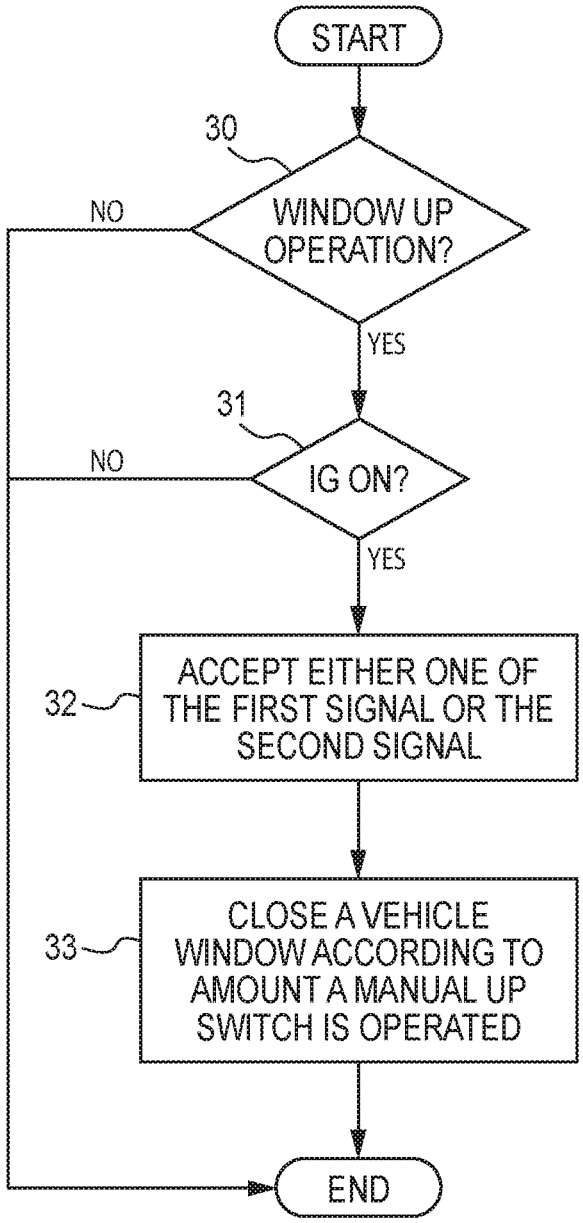
FIG. 3 is a flow chart of a first embodiment.

FIG. 3 show a flow chart of a first embodiment and a process regarding how the vehicle window control system 1 works.

In step 30, the control portion 7*a* determines whether the manual up switch 2*c* is operated or not. If not, the process ends. If the manual up switch 2*c* is determined to be operated, the process goes to step 31.

In step 31, the control portion 7*a* determines whether the ignition switch 18 is turned on or not. If not, the process ends. If the ignition switch 18 is determined to be turned on, the process goes to step 32.

In step 32, the control portion 7*a* accepts either one of the first signal from the manual up switch 2*c* through the hardwire 12 or the second signal from the switch detection portion 2*a* through the serial communication and the process goes to step 33.

In step 33, the control portion 7*a* commands the motor drive circuit 7*c* to close the window according to amount the window switch portion 2*c* is manipulated based on the either one of the first signal and the second signal.

This vehicle window control system 1 of this embodiment allows vehicle windows to be closed in the case where the serial communication between the switch detection portion 2*a* and the control portion 7 fails.

Figure 4:
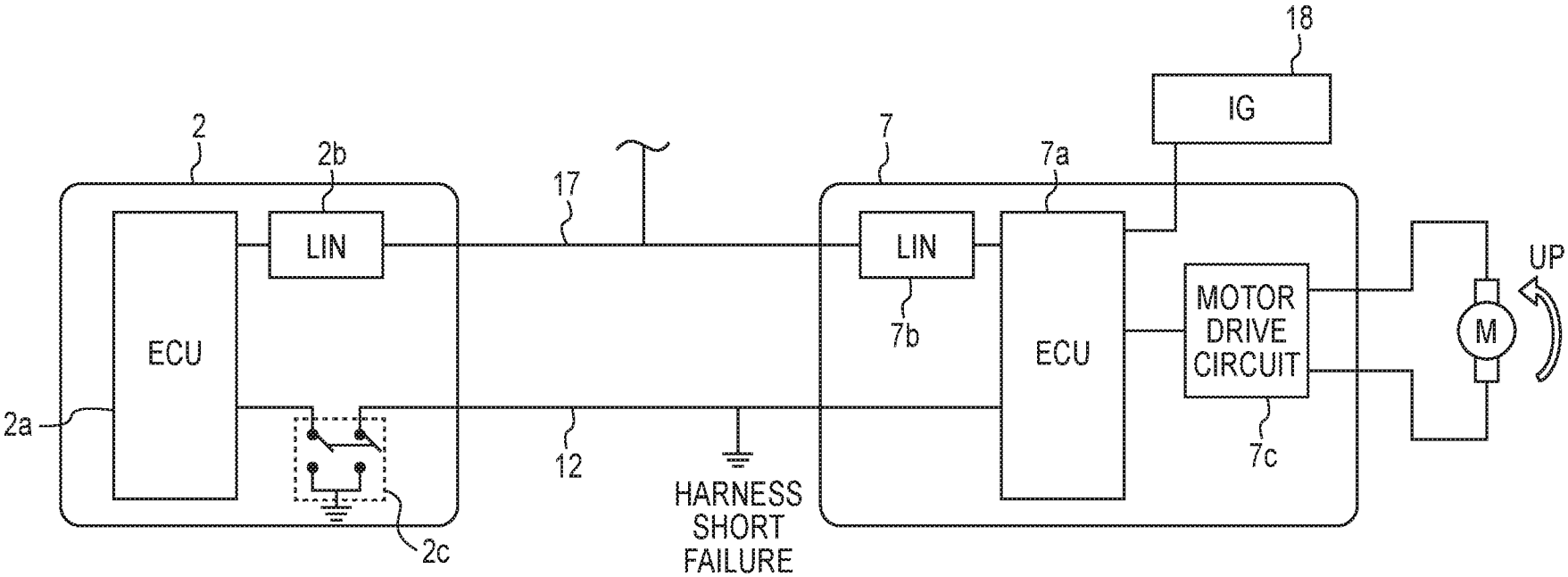
FIG. 4 is a diagram explaining a technical issue a first embodiment may have.
Figure 5:
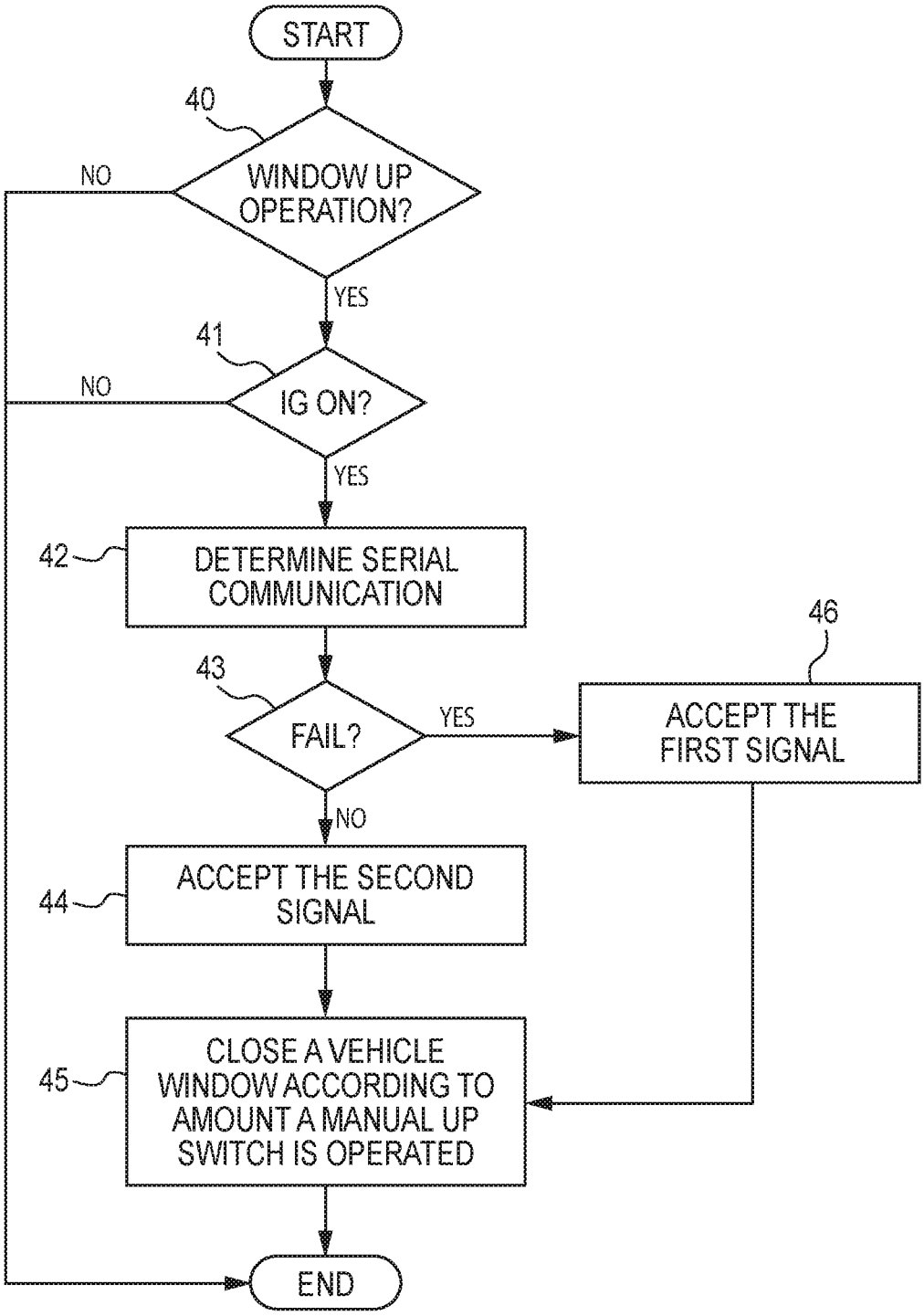
FIG. 5 is a flow chart of a second embodiment.

FIG. 5 shows a flow chart of a second embodiment and a process regarding how the vehicle window control system 1 works. In the first embodiment above, the vehicle window could close unexpectedly without operating the manual up switch 2*c* when the hardwire 12 shorts. FIG. 5 shows the situation where such an event occurs. FIG. 4 shows that a short circuit happens to the part of the hardwire 12 when the serial communication works properly. If the short circuit occurs, the control portion 7*a* may recognize that the manual up switch 2*c* is operated by the user and may command the motor drive circuit 7*c* close the vehicle window until the window is fully closed. Such issue can be resolved by the second embodiment described below.

Referring back to FIG. 5, in step 40, the control portion 7*a* determines whether the manual up switch 2*c* is operated or not. If not, the process ends. If the manual up switch 2*c* is determined to be operated, the process goes to step 41.

In step 41, the control portion 7*a* determines whether the ignition switch 18 is turned on or not. If not, the process ends. If the ignition switch 18 is determined to be turned on, the process goes to step 42.

In step 42, the control portion 7*a* determines whether the serial communication between the first serial communication interface 2*b* and the second serial communication interface 7*b* works or not and then the process goes to step 43. The control portion 7*a* may determines whether the switch detection portion 2*a* works properly or not.

Such determination on the serial communication failure or the switch detection portion 2*a* failure may be made as follows. For example, once the manual up switch 2*c* is operated, the control portion 7*a* receives two signals in normal condition. One is the second signal from the switch detection portion 2*a* through the first serial communication interface 2*b* and the second serial communication interface 7*b*. The other is the first signal from the manual up switch 2*c* through the hardwire 12. On the other hand, if the serial communication or the switch detection portion 2*a* fails, the control portion 7*a* receives only the first signal through the hardwire 12. Therefore, the control portion 7*a* can determine if the serial communication or the switch detection portion 2*a* fails by determining whether it receives both the second signal and first signal through the serial communication and the hardwire 12 or only the first signal through the hardwire 12.

Referring back to FIG. 5, in step 43, if the control portion 7*a* determines the serial communication or the switch detection portion 2*a* fails, the process goes to step 46. If the control portion 7*a* determines the serial communication works, the process goes to step 44.

In step 44, the control portion 7*a* is set to accept the second signal only from the switch detection portion 2*a* and then the process goes to step 45.

In step 46, the control portion 7*a* is set to accept the first signal only from the manual up switch 2*c* and then the process goes to step 45.

In step 45, the control portion 7*a* transmits a signal to command the motor drive circuit 7*c* to close the window by the motor M according to the amount the manual up switch 2*c* is manipulated. Then the process ends.

This embodiment allows the user to close the vehicle window when the serial communication fails. This embodiment also prevents the vehicle window from closing unexpectedly without operating the manual up switch 2*c* when the short circuit occurred to the hardwire 12 and the serial communication works properly.

Figure 6:
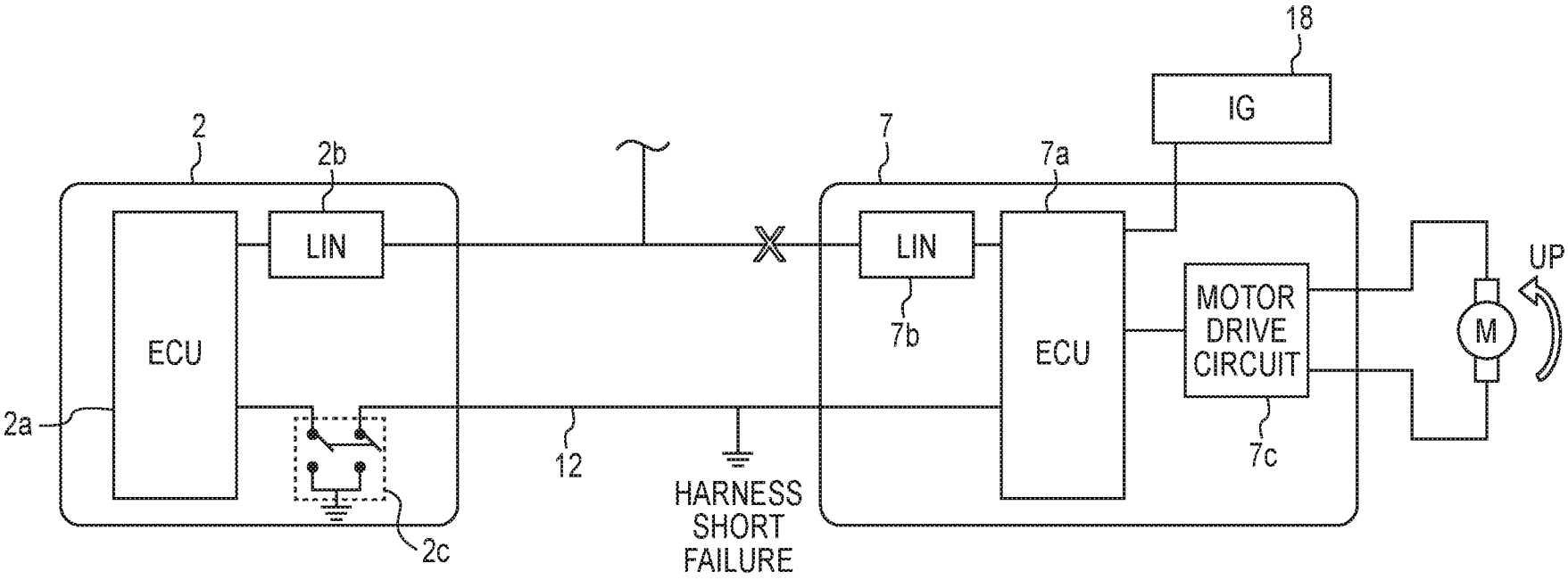
FIG. 6 is a diagram explaining a technical issue a second embodiment may have.
Figure 7:
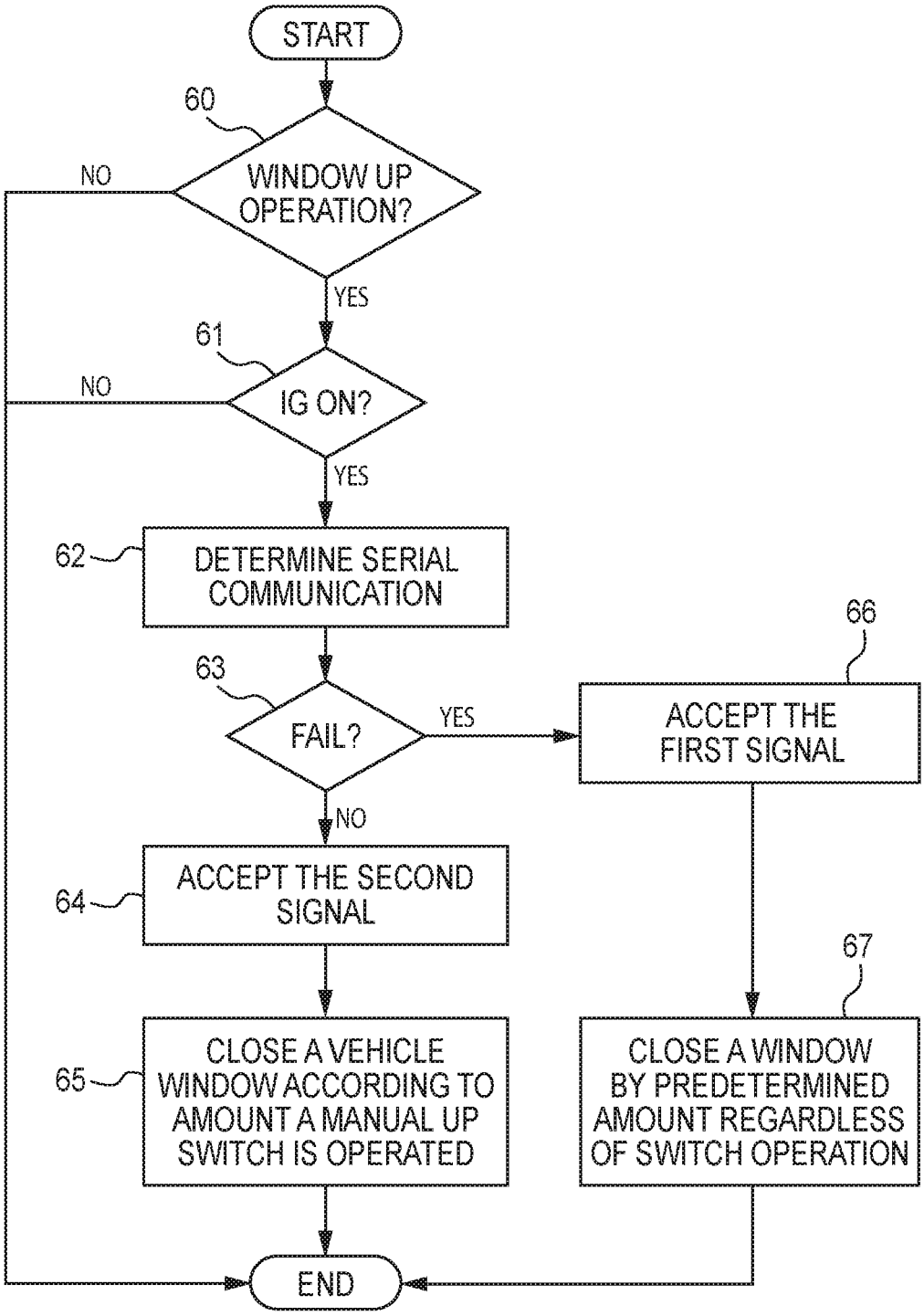
FIG. 7 is a flow chart of a third embodiment.

FIG. 7 shows a flow chart of a third embodiment. In the second embodiment above, the vehicle window could close unexpectedly without operating the manual up switch 2*c* when the serial communication fails and also the hardwire 12 shorts. FIG. 6 shows the situation where such an event occurs. FIG. 6 shows that a short circuit happens to the part of the hardwire 12 when the serial communication fails. If the short circuit occurs, the control portion 7*a* may recognize that the manual up switch 2*c* is operated by the user and command the motor drive circuit 7*c* to close the vehicle window until the window is fully closed. Such an issue can be resolved by the third embodiment described below.

Referring back to FIG. 7, in step 60, the control portion 7*a* determines whether the manual up switch 2*c* is operated or not. If not, the process ends. If the manual up switch 2*c* is determined to be operated, the process goes to step 61.

In step 61, the control portion 7*a* determines whether the ignition switch 18 is turned ON or turned OFF. If not, the process ends. If the ignition switch 18 is determined to be turned on, the process goes to step 62.

In step 62 and 63, the control portion 7*a* determines whether the serial communication between the first serial communication interface 2*b* and the second serial communication interface 7*b* works or not. The control portion 7*a* may determines whether the switch detection portion 2*a* works properly or not.

If the control portion 7*a* determines the serial communication or the switch detection portion 2*a* fails, the process goes to step 66. If the control portion 7*a* determines the serial communication works properly, the process goes to step 64.

In step 64, the control portion 7*a* is set to accept only the second signal from the switch detection portion 2*a* and then the process goes to step 65. In step 66, the control portion 7*a* is set to accept only the first signal from the manual up switch 2*c* and then the process goes to step 67.

In step 65, the control portion 7*a* transmits a signal to command the motor drive circuit 7*c* close the window by the motor M according to the amount the manual up switch 2*c* is manipulated. Then the process ends.

In step 67, the control portion 7*a* commands the motor drive circuit to close the window by a predetermined amount regardless of the user's switch operation. Then the process ends.

Figure 8:
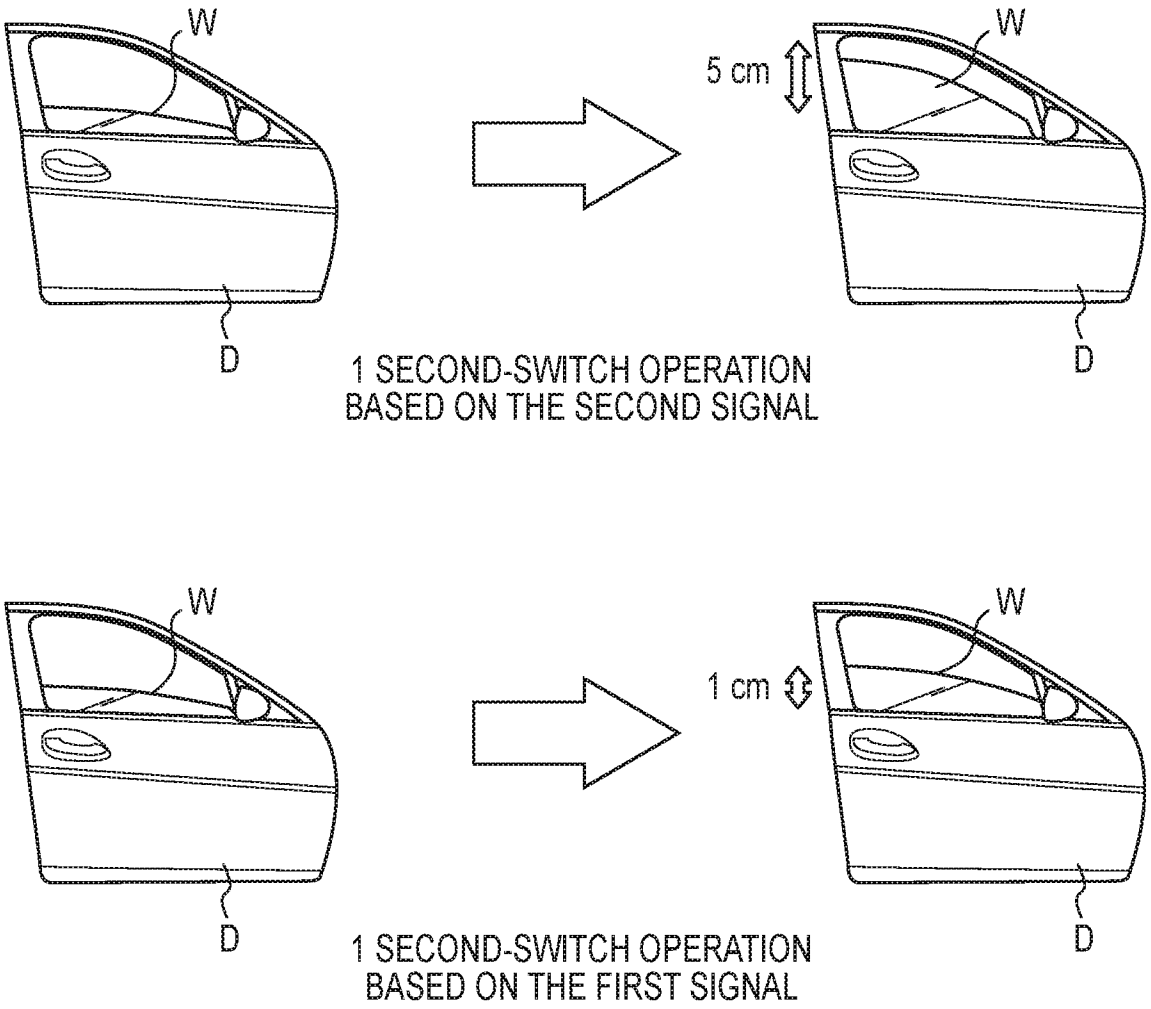
FIG. 8 is an example for closing a vehicle window with certain switch operation.

The predetermined amount may be 1 cm or less than 1 cm, for example. The predetermined amount is set to less than the amount by which the vehicle window will fully be closed in order to prevent the vehicle window from fully being closed unexpectedly. Further, the predetermined amount with a certain switch operation may be less than the amount by which the control portion 7*a* closes the vehicle window based on the second signal through the serial communication with the same switch operation as the certain operation above while the manual switch 2*c* is being turned on. FIG. 8 shows an example for closing the vehicle window W of the vehicle door D by the predetermined amount. The control portion 7*a* may close the vehicle window W by 5 cm based on the second signal from the serial communication with the certain switch operation (i.e. keep the manual up switch 2*c* ON for 1 second), on the other hand, the control portion 7*a* may close the vehicle window W by 1 cm based on the first signal from the hardwire 12 with the same switch operation as the certain switch operation.

Figure 9:
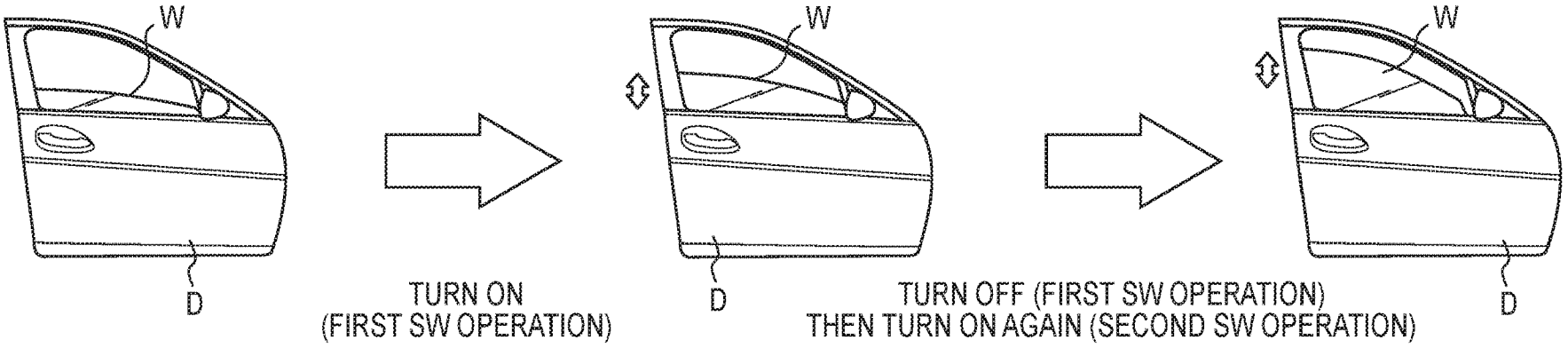
FIG. 9 is an example for closing a vehicle window with certain switch operation.

The user can close the vehicle window fully by continuing to turn on and off the manual up switch 2*c* until the vehicle window is fully closed. FIG. 9 shows an example for closing the vehicle window W of a vehicle door D in such a way. The vehicle window W closes by the predetermined amount (i.e. 1 cm) in repose to a first switch operation (turned on), and the vehicle window W closes by another predetermined amount (i.e. 1 cm) in response to a second switch operation (turned on) after the first switch operation is completed (turned off). By repeating the switch operations, the user can close the vehicle window W little by little until it is fully closed. The predetermined amount may be different from the another predetermined amount. For example, the predetermined amount may be 1 cm and the another predetermined amount may be 2 cm.

The vehicle window control system 1 of the third embodiment allows the user to close the vehicle window when the serial communication fails. It also prevents the vehicle windows from being fully closed unexpectedly without operating the manual up switch 2*c* when the serial communication fails and the hardwire 12 shorts.

Although the above embodiments focus on communication between the driver window switch panel 2 and the driver window control portion 7, the same system may also be applied to communication between the assistant window switch panel 3 and the assistant window control portion 8, between the rear left window switch panel 4 and the rear left window control portion 9, between the rear right window switch panel 5 and the rear right window control portion 10, or between the sunroof switch panel 6 and the sunroof control portion 11.

The foregoing description of embodiments and examples has been presented for purposes of illustration and description. It is not intended to be exhaustive or to limit the invention to the forms described. Numerous modifications are possible in light of the above teachings. Some of those modifications have been discussed and others will be understood by those skilled in the art. The embodiments were chosen and described in order to best illustrate certain principles and various embodiments as are suited to the particular use contemplated. The scope of the invention is, of course, not limited to the examples or embodiments set forth herein, but can be employed in any number of applications and equivalent devices by those of ordinary skill in the art. Rather it is hereby intended the scope of the invention be defined by the claims appended hereto.

What is claimed is:

1. A vehicle window control system comprising:

a window switch in a switch panel that generates a first signal, a first computer in the switch panel that reads a state of the window switch and generates a second signal, and a second computer in a window control unit that controls movement of the vehicle window based on either the first signal from the window switch in the switch panel or the second signal from the first computer in the switch panel, wherein the second computer in the widow control unit receives the second signal from the first computer in the switch panel through serial communication and the first signal from the window switch in the switch panel through a hardwire, wherein when the second computer in the window control unit determines that the serial communication works properly, the second computer prioritizes the second signal from the first computer in the switch panel over the first signal from the window switch in the switch panel and closes the window based on the second signal by a switch operated amount from a first switch operation of the window switch, and wherein when the second computer in the window control unit determines that the serial communication fails, the second computer prioritizes the first signal from the window switch in the switch panel over the second signal from the first computer in the switch panel and closes the vehicle window based on the first signal by a first predetermined amount that is an automatic movement and set to less than an amount by which the window will be fully closed while the window switch is turned on regardless of the switch operated amount with the first switch operation.

2. The vehicle window control system according to claim 1, wherein the second computer closes the vehicle window by a second predetermined amount when the window switch is turned off and then is turned on again, after the second computer closes the vehicle window by the first predetermined amount.

3. The vehicle window control system according to claim 1, wherein the second computer closes the vehicle window based on the first signal by the first predetermined amount which is less than the switch operated amount with the first switch operation.

4. The vehicle window control system according to claim 1, wherein the second computer determines whether the serial communication works or not based on whether the second computer receives both the first signal and the second signal or the second computer receives only the first signal.

5. The vehicle window control system according to claim 1, wherein the second computer receives a signal indicating whether a vehicle ignition switch or a vehicle main switch is turned on or off and the second computer closes the vehicle window in response to either the first signal or the second signal only when second computer detects that the vehicle ignition switch or the vehicle main switch is on.

6. A vehicle window control method comprising:

obtaining a first signal through a hardwire from a window switch in a switch panel, obtaining a second signal through a serial communication from a first computer in the switch panel that reads a state of the window switch, and closing a vehicle window based on either the first signal from the window switch in the switch panel or the second signal from the first computer in the switch panel, determining whether the serial communication fails or not, prioritizing the second signal from the first computer in the switch panel over the first signal from the window switch in the switch panel when the serial communication is determined not to fail, and closing the vehicle window based on the second signal from the first computer in the switch panel by a switch operated amount from a first switch operation of the window switch, and prioritizing the first signal from the window switch in the switch panel over the second signal from the first computer in the switch panel when the serial communication is determined to fail, and closing the vehicle window based on the first signal by a first predetermined amount that is an automatic movement and set to less than an amount by which the window will be fully closed while the window switch is turned on regardless of the switch operated amount with the first switch operation.

7. The vehicle window control method according to claim 6, further comprising:

closing the vehicle window by a second predetermined amount when the window switch is turned off and then is turned on again, after closing the vehicle window by the first predetermined amount.

8. The vehicle window control method according to claim 6, further comprising:

closing the vehicle window based on the first signal by the first predetermined amount which is less than the switch operated amount with the first switch operation.

9. The vehicle window control method according to claim 6, further comprising:

determining whether the serial communication fails or not based on whether both the first signal and the second signal are received or only the first signal is received.

10. The vehicle window control method according to claim 6, further comprising:

obtaining a signal indicating whether a vehicle ignition switch or the vehicle main switch is turned on or off, and closing the vehicle window in response to either the first signal or the second signal only when the vehicle ignition switch or the vehicle main switch is detected to be on.

11. A vehicle window control system comprising:

a window switch in a switch panel that generates a first signal, a first computer in the switch panel that reads a state of the window switch and generates a second signal, and a second computer in a window control unit that controls movement of the vehicle window based on either the first signal from the window switch or the second signal from the first computer in the switch panel, wherein when the second computer in the window control unit determines that the first computer in the switch panel works properly, the second computer prioritizes the second signal from the first computer in the switch panel over the first signal from the window switch in the switch panel and the second computer closes the vehicle window based on the second signal from the first computer by a switch operated amount from a first switch operation of the window switch, and wherein when the second computer in the window control unit determines that the first computer in the switch panel fails, the second computer prioritizes the first signal from the window switch in the switch panel over the second signal from the first computer in the switch panel and the second computer closes the vehicle window based on the first signal by a predetermined amount that is an automatic movement and set to less than an amount by which the window will be fully closed while the window switch is turned on regardless of the switch operated amount with the first switch operation.

12. The vehicle window control system according to claim 11, wherein the second computer determines whether the first computer works or not based on whether the second computer receives both the first signal and the second signal or the second computer receives only the first signal.

13. The vehicle window control system according to claim 11, wherein the second computer closes the vehicle window based on the first signal by the predetermined amount which is less than the switch operated amount with the first switch operation.

* * * * *